US007780367B2

(12) United States Patent
Yoshioka

(10) Patent No.: US 7,780,367 B2
(45) Date of Patent: Aug. 24, 2010

(54) THERMAL PRINTER WITH COMPACT STRUCTURE AND USABILITY OF COVER OPEN AND COVER OPEN MECHANISM

(75) Inventor: Yukio Yoshioka, Kawasaki (JP)

(73) Assignee: NEC Infrontia Corporation, Kanagawa (JP)

( * ) Notice: Subject to any disclaimer, the term of this patent is extended or adjusted under 35 U.S.C. 154(b) by 934 days.

(21) Appl. No.: 11/519,819

(22) Filed: Sep. 13, 2006

(65) Prior Publication Data

US 2007/0059074 A1 Mar. 15, 2007

(30) Foreign Application Priority Data

Sep. 14, 2005 (JP) ..... 2005-266709

(51) Int. Cl.
*B41J 2/22* (2006.01)

(52) U.S. Cl. ..... 400/120.16; 400/649; 400/691; 347/197; 347/198; 347/220; 347/222

(58) Field of Classification Search ..... 400/120.16, 400/120.17, 120.01, 649, 653, 691–693; 347/197–198, 220, 222
See application file for complete search history.

(56) References Cited

U.S. PATENT DOCUMENTS

| | | | | |
|---|---|---|---|---|
| 6,249,302 | B1 * | 6/2001 | Sekiya | 347/220 |
| 6,450,714 | B2 * | 9/2002 | Mori et al. | 400/649 |
| 6,567,113 | B2 * | 5/2003 | Louis | 347/222 |
| 6,765,602 | B2 * | 7/2004 | Mori | 347/220 |

FOREIGN PATENT DOCUMENTS

| | | | |
|---|---|---|---|
| JP | 1-121875 | A | 5/1989 |
| JP | 1-168474 | A | 7/1989 |
| JP | 2-160558 | A | 6/1990 |
| JP | 10-114091 | A | 5/1998 |
| JP | 2000-318239 | A | 11/2000 |
| JP | 2001-96839 | A | 4/2001 |
| JP | 2004-195805 | A | 7/2004 |

* cited by examiner

*Primary Examiner*—Judy Nguyen
*Assistant Examiner*—Marissa L Ferguson-Samreth
(74) *Attorney, Agent, or Firm*—Sughrue Mion, PLLC

(57) ABSTRACT

A cover operation member (41) is movably attached to the base frame to selectively latch and unlatch a platen (21) attached on the cover frame. The cover operation member (41) is in contact with the head bracket (32) so that the thermal head (31) is separated from the platen (21).

18 Claims, 8 Drawing Sheets

THERMAL PRINTER WITH COMPACT STRUCTURE AND USABILITY OF COVER OPEN AND COVER OPEN MECHANISM

This application claims priority to prior Japanese patent application JP 2005-266709, the disclosure of which is incorporated herein by reference.

BACKGROUND OF THE INVENTION

The present invention relates to a thermal printer for printing on a thermal roll sheet with a thermal head while feeding the thermal roll sheet. The present invention also relates to a cover open mechanism applied to such a thermal printer.

Generally, this type of thermal printer has a simple structure and is thus advantageous in miniaturization, cost reduction, and facilitation of maintenance. Accordingly, this type of thermal printer is used in various devices or systems which require miniaturization, cost reduction, and facilitation of maintenance, such as POS terminals for issuing receipts and automatic dispensers for issuing tickets or coupons.

This type of thermal printer has a base frame, a cover frame capable of opening and closing with respect to the base frame, a platen mounted on the cover frame, and a linear thermal head mounted on the base frame. The thermal head is operable to press the platen in a radial direction of the platen.

The thermal head is mounted on a head bracket, which is attached to the base frame in a movable state. Further, a cover operation member for opening and closing the cover frame is attached to the base frame in a movable state. The thermal head is biased together with the head bracket by coil springs or the like so as to press the platen when the cover frame is closed. The conventional thermal head is biased together with the head bracket so as to press the platen in a radial direction of the platen that is in parallel to a direction in which the cover frame is to be opened.

The thermal printer having the above structure is used in the following manner.

First, the cover operation member, which is attached to the base frame in a movable state, is operated so as to unlatch the cover frame. When the cover frame is unlatched, the cover frame is automatically pushed and opened because the platen is pushed by a biasing force of the thermal head. Then, a thermal roll sheet is set on a set position for the thermal roll sheet, which is exposed when the cover frame is opened. An end of the thermal roll sheet is manually fed by a proper length and placed on the thermal head. Subsequently, the cover frame is closed. The cover frame is held in the closed state by the cover operation member.

When a printing command is inputted after power is turned on, the thermal head prints on the sheet between the platen and the thermal head while the platen is rotated to feed the thermal roll sheet.

The printed sheet, which passes between the platen and the thermal head, is guided along a quadrant path formed in the cover frame so as to turn at 90 degrees and then discharged from a discharge port formed in a top surface of the cover frame. The quadrant path has a relatively large curvature so as to prevent a frictional resistance from increasing to cause a paper jam when a paper passes through the quadrant path. Accordingly, the quadrant path has a relatively large size.

The inventors have developed a structure for reducing the size of a conventional thermal printer by eliminating a quadrant path as described above. In this structure, a thermal head is biased together with a head bracket so as to press a platen in a radial direction of the platen that is substantially perpendicular to a direction in which a cover frame is to be opened.

Specifically, a printed sheet which passes between the platen and the thermal head, is directed toward a discharge port formed in a top surface of the cover frame without changing from a direction in which the printed sheet passes between the platen and the thermal head. Thus, this improved structure can eliminate a space required for a quadrant path in the conventional structure and can thus reduce the size of a thermal printer.

However, in the aforementioned structure, even if the cover frame is unlatched by operating the cover operation member in order to set a thermal roll sheet on the thermal printer, the cover frame is not automatically opened for the following reasons. Since the thermal head is biased so as to press the platen in a direction substantially perpendicular to a direction in which the cover frame is to be opened, the cover frame (the platen mounted on the cover frame) is not biased in the direction in which the cover frame is to be opened by the thermal head. Additionally, since the platen is pressed in the aforementioned direction by the thermal head, the cover frame is held so as not to be opened.

Accordingly, in order to open the cover frame, a user has to operate the cover operation member by one hand to unlatch the cover frame and hold the cover frame by the other hand to lift the cover frame. Thus, it is not easy to use the improved structure.

The following structure may be considered in order to solve the above problem. A spring is provided for biasing the cover frame in a direction in which the cover frame is to be opened. When the cover operation member is operated, the cover frame is unlatched while the pressing of the platen by the thermal head is released. The free cover frame is automatically opened by a force of the spring.

However, according to experiments conducted by the inventors, a considerably large operating force was required during an overall operation after the operation of the cover operation member was started. Thus, it was found that the usability was degraded. This was caused by the fact that a biasing force applied to the thermal head was as large as about 1.5 kgf because of specifications of the thermal printer.

SUMMARY OF THE INVENTION

It is, therefore, an object of the present invention is to provide a thermal printer having a compact structure without causing impaired usability to open a cover frame.

The present invention is directed to a thermal printer comprising a base frame on which a thermal roll sheet is mounted, a cover frame attached to the base frame so as to be opened and closed, a platen mounted on the cover frame for feeding the thermal roll sheet, a head bracket attached to the base frame in a movable state, a thermal head mounted on the head bracket for printing on the thermal roll sheet between the platen and the thermal head, the thermal head being biased together with the head bracket so as to press the platen in a radial direction of the platen when the cover frame is closed, and a cover operation member movably attached to the base frame to selectively latch and unlatch the cover frame. The cover operation member is in contact with the head bracket so that the thermal head is separated from the platen.

The cover operation member may comprise a lever manually rotated in clockwise and counterclockwise directions around a rotational axis on the base frame, a hook portion extended from the lever to selectively latch and unlatch the platen, and a drive portion extended from the lever to be made contact with the head bracket.

The thermal printer may further comprises a head engagement member engaging with the head bracket so that the thermal head is separated from the platen when the cover frame is closed.

The cover operation member may latch a rotational shaft of the platen in a state in which the platen is allowed to rotate.

The cover frame may be biased in a direction in which the cover frame is to be opened.

The cover operation member may be biased toward a position so as to latch the cover frame.

The cover operation member that is located on a position so as to latch the cover frame may be fitted within an outline of the thermal printer including the base frame and the closed cover frame.

The cover frame, the head bracket, and the cover operation member may be rotatably operated.

The cover operation member may selectively move between a first position to latch the cover frame that is closed and a second position to unlatch the cover frame and between the second position and a third position to press the head bracket so that the thermal head is separated from the platen, the third position being located farther away from the first position than the second position.

The present invention is further directed to a cover open mechanism used for a thermal printer comprising a base frame on which a thermal roll sheet is mounted, a cover frame attached to the base frame so as to be opened and closed, a platen mounted on the cover frame for feeding the thermal roll sheet, a head bracket attached to the base frame in a movable state, and a thermal head mounted on the head bracket for printing on the thermal roll sheet between the platen and the thermal head, the thermal head being biased together with the head bracket so as to press the platen in a radial direction of the platen when the cover frame is closed. The cover open mechanism comprises a cover operation member movably attached to the base frame to selectively latch and unlatch the cover frame, the cover operation member being mechanically coupled with the head bracket so that the thermal head is separated from the platen.

The cover operation member may comprise a lever manually rotated in clockwise and counterclockwise directions around a rotational axis on the base frame, a hook portion extended from the lever to selectively latch and unlatch the platen, and a drive portion extended from the lever to be made contact with the head bracket.

The cover operation member may latch a rotational shaft of the platen in a state in which the platen is allowed to rotate.

The cover operation member may be biased toward a position so as to latch the cover frame.

The cover operation member that is located on a position so as to latch the cover frame may fitted within an outline of the thermal printer including the base frame and the closed cover frame.

The cover frame, the head bracket, and the cover operation member may be operated with a turning movement.

The cover operation member selectively move between a first position to latch the cover frame that is closed and a second position to unlatch the cover frame and between the second position and a third position to press the head bracket so that the thermal head is separated from the platen, the third position being located farther away from the first position than the second position.

DESCRIPTION OF THE PREFERRED EMBODIMENTS

A thermal printer and a cover open mechanism according to an embodiment of the present invention will be described below with reference to FIGS. 1 through 8.

Figure 1:
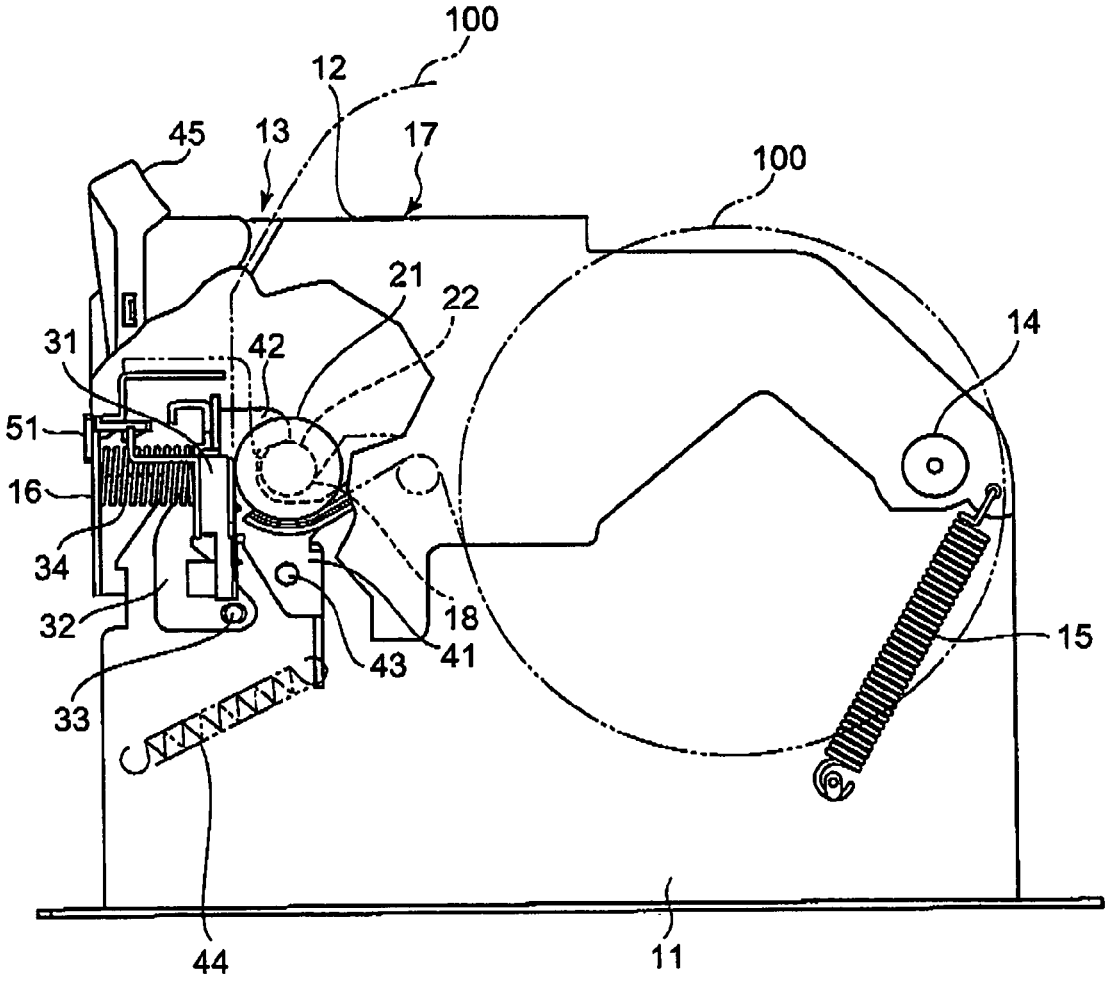
FIG. 1 is a side view, partially transparently, showing a thermal printer according to an embodiment of the present invention.

Referring to FIG. 1, the thermal printer according to the embodiment of the present invention is in the form of a unit detachably mounted on a POS terminal device (not shown). The thermal printer has a base frame 11 on which a thermal roll sheet 100 can be mounted, a cover frame 12 attached to the base frame 11 so as to be opened and closed by turning movement about a rotational shaft 14, a platen 21 mounted on the cover frame 12 so as to be pivotable about a rotational shaft 22, a thermal head 31, a head bracket 32, and a cover operation member (cover open/close member) 41. In the present embodiment, the thermal printer is mounted on a POS terminal device in a state such that the base frame 11 and the cover frame 12 are positioned at lower and upper portions of the thermal printer, respectively.

The head bracket 32 is attached to the base frame 11 so as to be pivotable about a rotational shaft 33.

The thermal head 31 is mounted on the head bracket 32. The thermal head 31 is biased and pushed together with the head bracket 32 by two coil springs 34 so that the thermal head 31 presses the platen 21. Specifically, when the cover frame 12 is closed, the thermal head 31 presses the platen 21 in a radial direction of the platen 21 that is substantially perpendicular to a direction in which the cover frame 12 is to be opened. The coil springs 34 are supported by a stay 16 fixed to the base frame 11.

The cover operation member 41 is attached to the base frame 11 so as to pivotable about a rotational shaft 43 between a first position and a second position. When the cover frame 12 is closed, the cover operation member 41 latches the rotational shaft 22 of the platen 21, which is mounted on the cover frame 12, with a hook portion 42 at the first position. Thus, the cover operation member 41 latches the cover frame 12 at the first position when the cover frame 12 is closed. The platen 21 is allowed to rotate when the rotational shaft 22 of the platen 21 is latched by the hook portion 42. The cover operation member 41 unlatches the cover frame 12 (i.e., the rotational shaft 22 of the platen 21 mounted on the cover frame 12) at the second position. The cover operation member 41 has a lever 45 attached to its top end. When a user rotates the lever 45 counterclockwise in FIG. 1, the cover operation member 41 is moved from the first position to the second position.

The cover frame 12 is biased and pulled by a coil spring 15. The cover operation member 41 is biased and pulled toward the first position by a coil spring 44.

When the cover operation member 41 is located at the first position, it is fitted or placed within an outline of the thermal printer including the base frame 11 and the closed cover frame 12. Thus, a space required for mounting the thermal printer can be reduced in the POS terminal device. Further, when the thermal printer is to be distributed as a unit, packaging for the thermal printer can be made compact in size.

In the thermal printer, the thermal head 31 conducts thermal printing on the sheet between the platen 21 and the thermal head 31 while the thermal roll sheet 100 mounted on the base frame 11 is fed by the platen 21. The printed sheet is discharged from a discharge port 13, which is formed in a top surface 17 of the cover frame 12, along a direction in which the printed sheet passes between the platen 21 and the thermal head 31.

Figure 2:
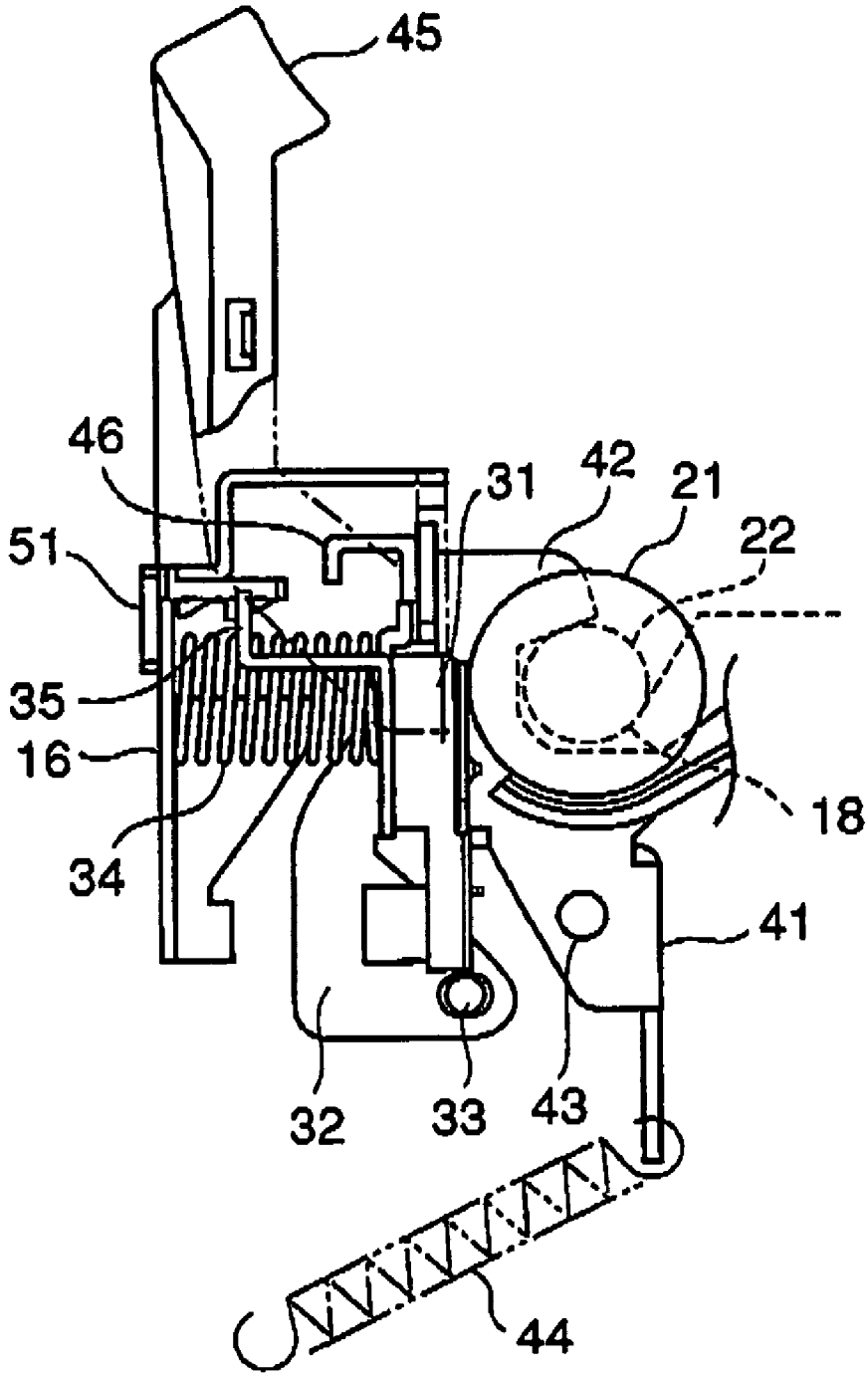
FIG. 2 is a view showing a main part of the thermal printer shown in FIG. 1 for explanation of operation of a cover open mechanism in the thermal printer.
Figure 3:
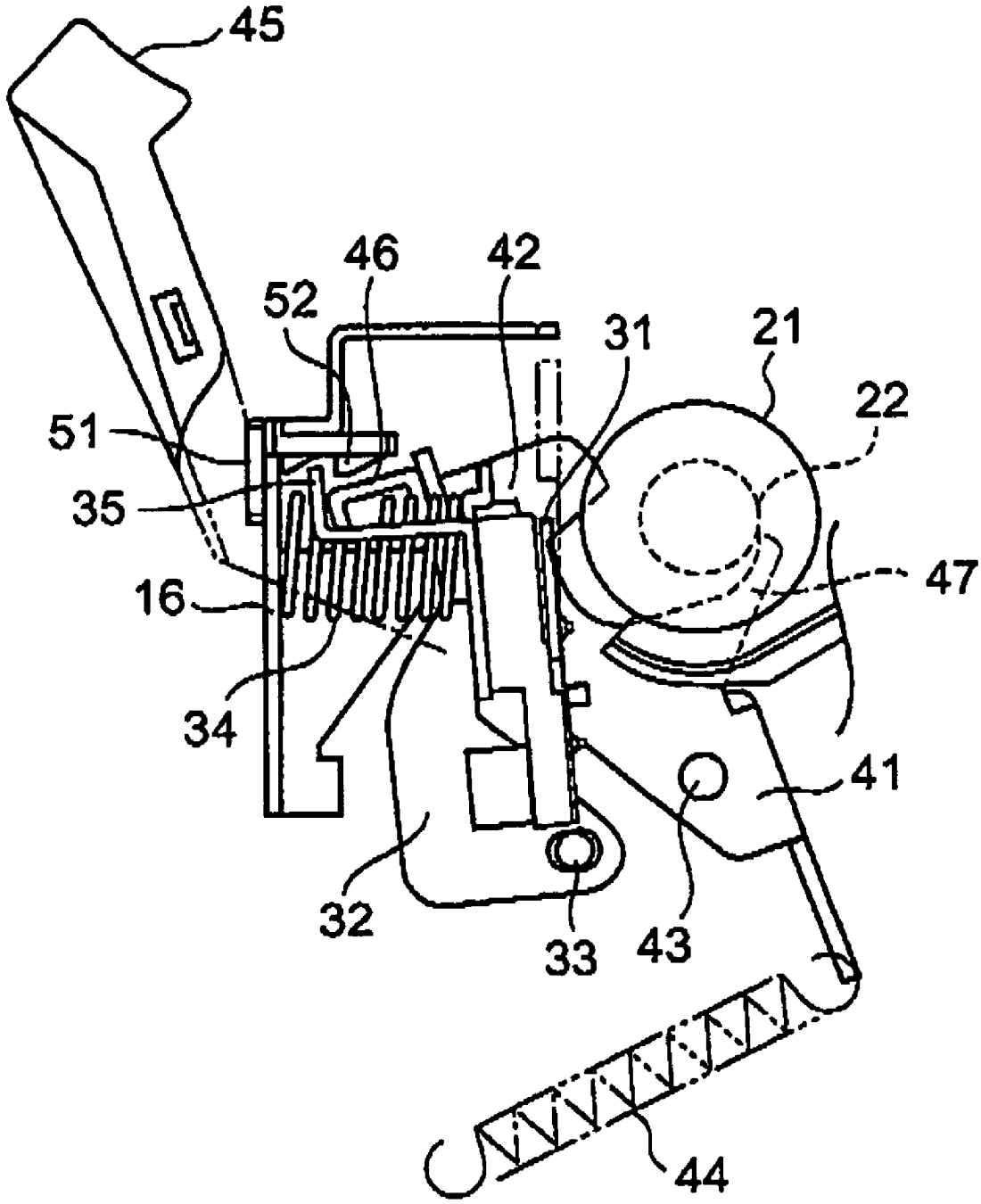
FIG. 3 is a view showing the main part of the thermal printer shown in FIG. 1 for explanation of operation of the cover-open mechanism in the thermal printer.

Referring to FIGS. 1 through 3, in the thermal printer, the cover operation member 41 is configured to be pivotable between the first position shown in FIG. 2 and a third position shown in FIG. 3, which is located farther away from the first position than the second position (not shown). When the cover operation member 41 is located at the third position, the cover operation member 41 presses the head bracket 32 so that the thermal head 31 is separated from the platen 21 of the closed cover frame 12.

The thermal printer operates in the following manner. The thermal printer is now in a state shown in FIG. 2. FIG. 2 shows a normal state, in which the thermal printer conducts or stops printing. At that time, the cover operation member 41 is at the first position. The rotational shaft 22 of the platen 21, which is rotatably mounted on the cover frame 12, is supported by a U-shaped shaft receiver 18 formed on the base frame 11 and latched by the hook portion 42 of the cover operation member 41 at the first position.

A user pulls down the lever 45 counterclockwise in FIG. 2. This operation of the lever 45 causes the cover operation member 41 to be rotated about the rotational shaft 43. Thus, the rotational shaft 22 of the platen 21 mounted on the cover frame 12 is unlatched from the hook portion 42 of the cover operation member 41. Then, the cover operation member 41 is moved to the second position. At that time, although not shown in the drawings, a projection 46 as a drive portion of the cover operation member 41 is about to be made contact with a contact portion 35 of the head bracket 32 as a driven portion.

An operating force to perform the above process, i.e., an operating force to move the cover operation member 41 from the first position to the second position, is small because the operating force needs only a resistance to a force by which the coil spring 44 biases the cover operation member 41 so as to return the cover operation member 41 to the first position.

Even if the rotational shaft 22 of the platen 21 is unlatched from the hook portion 42 of the cover operation member 41, the cover frame 12 is not automatically opened because the thermal head 31 is pressed by the platen 21.

When the user pulls down the lever 45 of the cover operation member 41 at the second position counterclockwise, the projection 46 of the cover operation member 41 is brought into abutment against the contact portion 35 of the head bracket 32.

When the user further pulls down the lever 45 counterclockwise, the head bracket 32 is pressed by the cover operation member 41 because the contact portion 35 of the head bracket 32 is held in abutment against the projection 46 of the cover operation member 41. Thus, the head bracket 32 is pivoted about the rotational shaft 33 into a state shown in FIG. 3.

At that time, the thermal head 31 is separated from a circumferential surface of the platen 21. Thus, the pressure applied to the platen 21 by the thermal head 31 is eliminated. Then, the rotational shaft 22 of the platen 21 supported by the shaft receiver 18 of the base frame 11 is pushed by a push piece 47 provided on the cover operation member 41.

Further, the cover frame 12 (not shown in FIG. 3) is automatically opened about the rotational shaft 14 by the tensile force of the coil spring 15.

When the cover frame 12 is opened, a portion of the base frame 11 to which the thermal roll sheet 100 is mounted is exposed. Thus, the thermal roll sheet 100 can be mounted onto the base frame 11. FIG. 3 shows the cover operation member 41 located at the third position. When the user looses his/her hand from the lever 45, the cover operation member 41 at the third position is pivoted about the rotational shaft 43 by the pushing force of the coil springs 34 via the head bracket 32 and the tensile force of the coil spring 44. Accordingly, the cover operation member 41 is automatically returned to the first position.

An operating force to move the cover operation member 41 form the second position to the third position is large because a biasing force applied to the thermal head 31 (head bracket 32) by the coil springs 34 to press the platen 21 is added to the resistance to the force by which the coil spring 44 biases the cover operation member 41 so as to return the cover operation member 41 to the first position.

However, in a through operation from the first position to the third position, because the operating force was small during a first stage from the first position to the second position, the usability was good even if the operating force was large during a second stage from the second position to the third position.

Subsequently, the thermal roll sheet 100 is set on a set position for the thermal roll sheet, which is exposed when the cover frame 12 is automatically opened.

An end of the thermal roll sheet is manually fed by a proper length and set in a vertical direction so as to face the thermal head 31.

Then, the cover frame 12 is closed. The cover frame 12 is held in the closed state by the latch of the cover operation member 41.

When a printing command is inputted after power is turned on, the thermal head 31 prints on the sheet between the platen 21 and the thermal head 31 while the platen 21 is rotated to feed the thermal roll sheet 100.

The printed sheet, which passes between the platen 21 and the thermal head 31, is discharged from the discharge port 13 formed in the top surface 17 of the cover frame 12.

In the thermal printer, the cover frame, the head bracket, and the cover operation member may operate with linear movement. However, when the cover frame, the head bracket, and the cover operation member operate with pivotal movement, the operating force can effectively be reduced by using leverage.

Further, the thermal printer has a head engagement member 51 engaging with the head bracket 32 to hold a state shown in FIG. 3, i.e., a state in which the cover operation member 41 is located at the third position to separate the thermal head 31 from the platen 21.

Operation of the head engagement member 51 will be described with reference to FIGS. 3 through 8.

Figure 4:
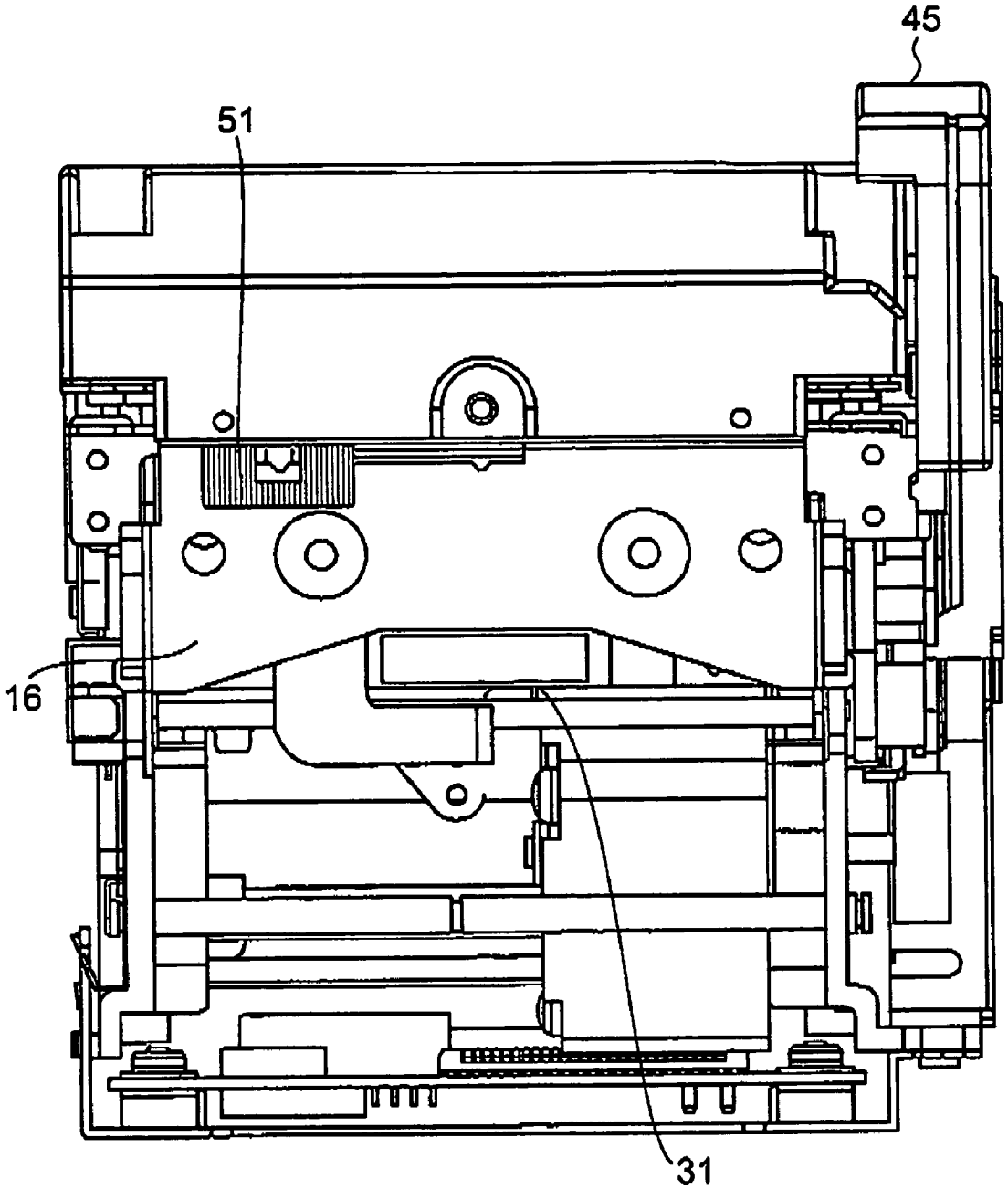
FIG. 4 is a front view explanatory of operation of the thermal printer shown in FIG. 1.
Figure 5:
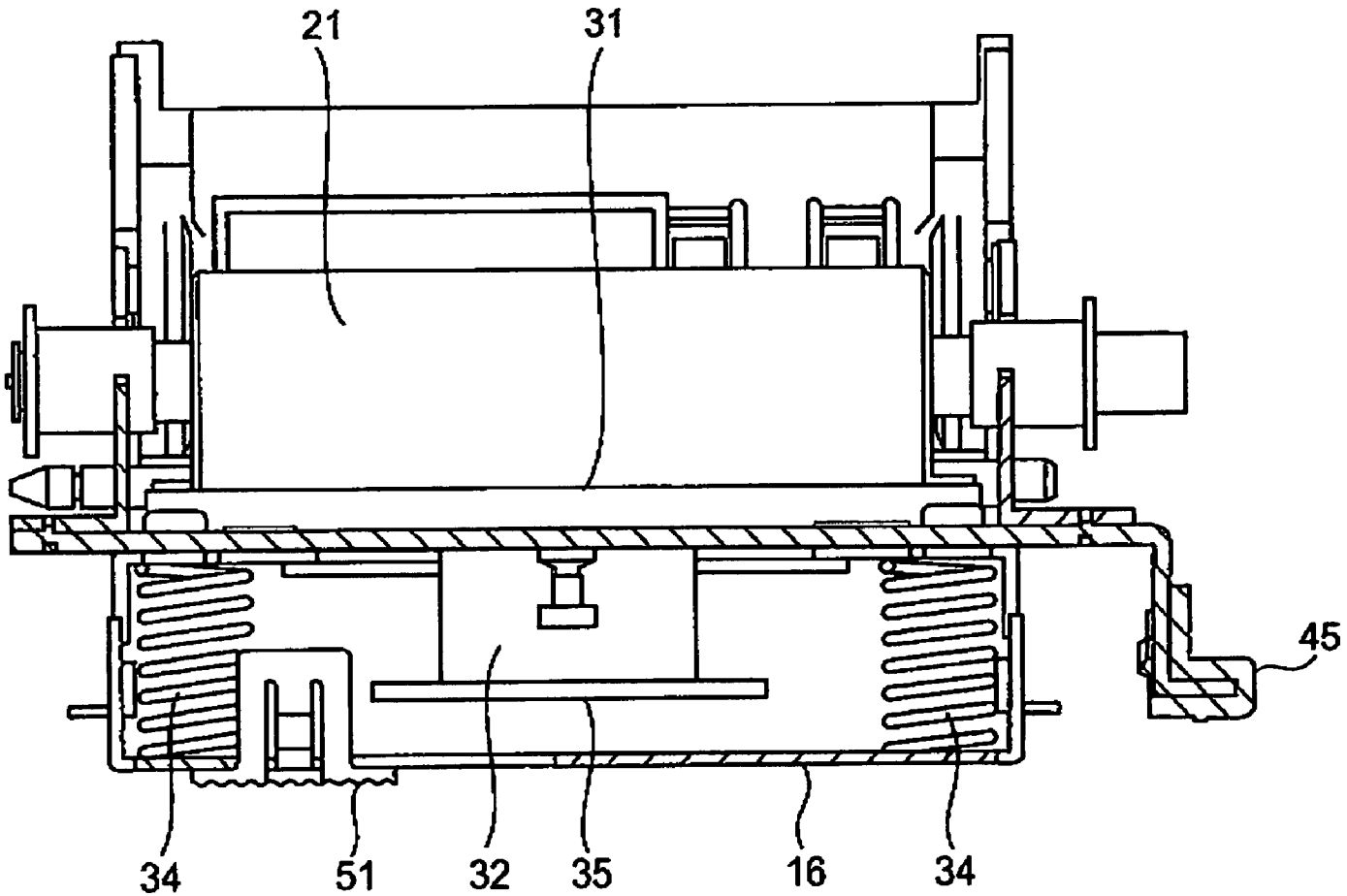
FIG. 5 is a plan view showing a main part of the thermal printer shown in FIG. 1 for explanation of operation of the thermal printer.

When the cover operation member 41 is located at the third position as shown in FIG. 3, the head engagement member 51 is located on the left side in the horizontal direction as shown in FIGS. 4 and 5.

Figure 7:
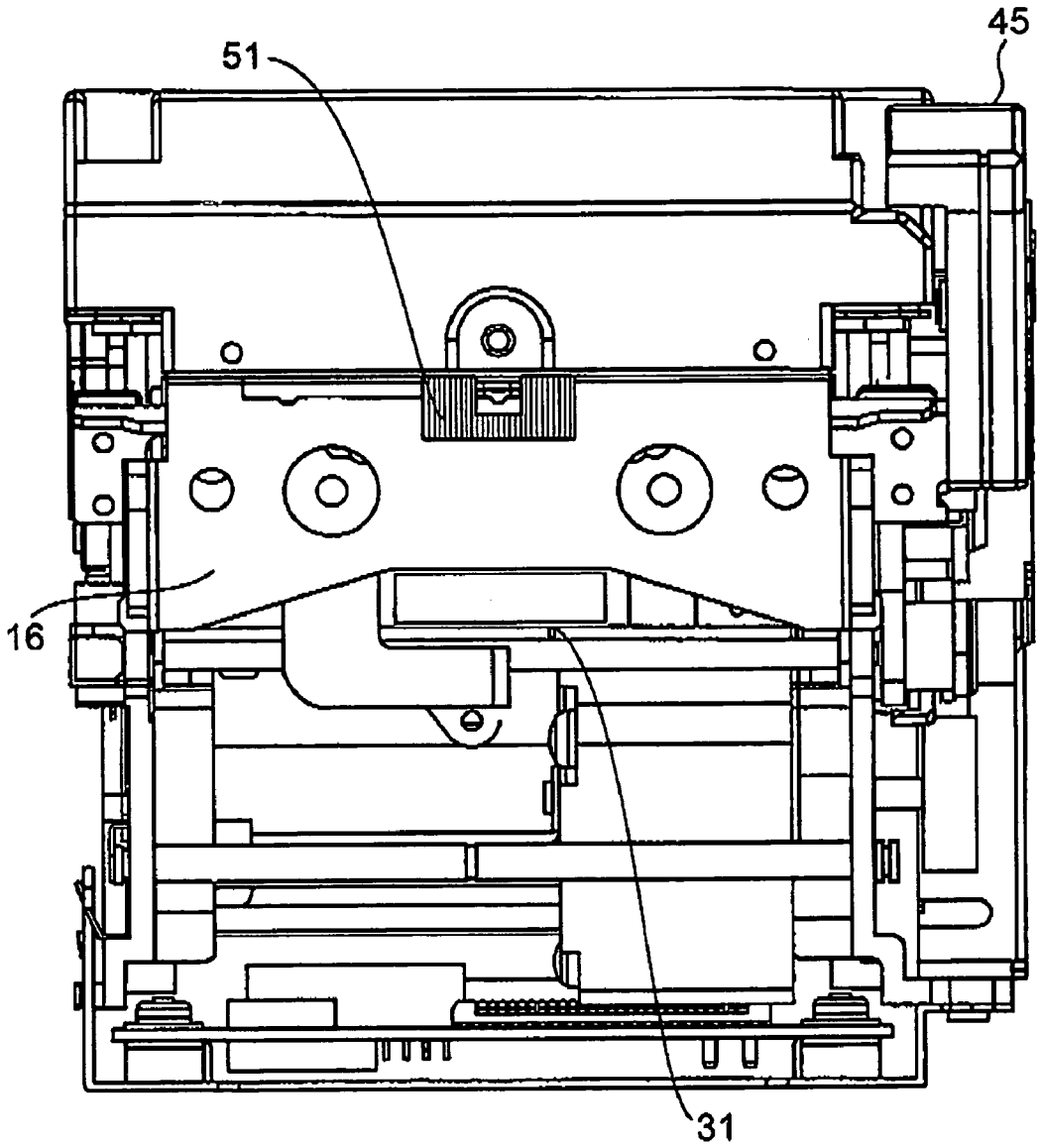
FIG. 7 is a front view explanatory of operation of the thermal printer shown in FIG. 1.
Figure 8:
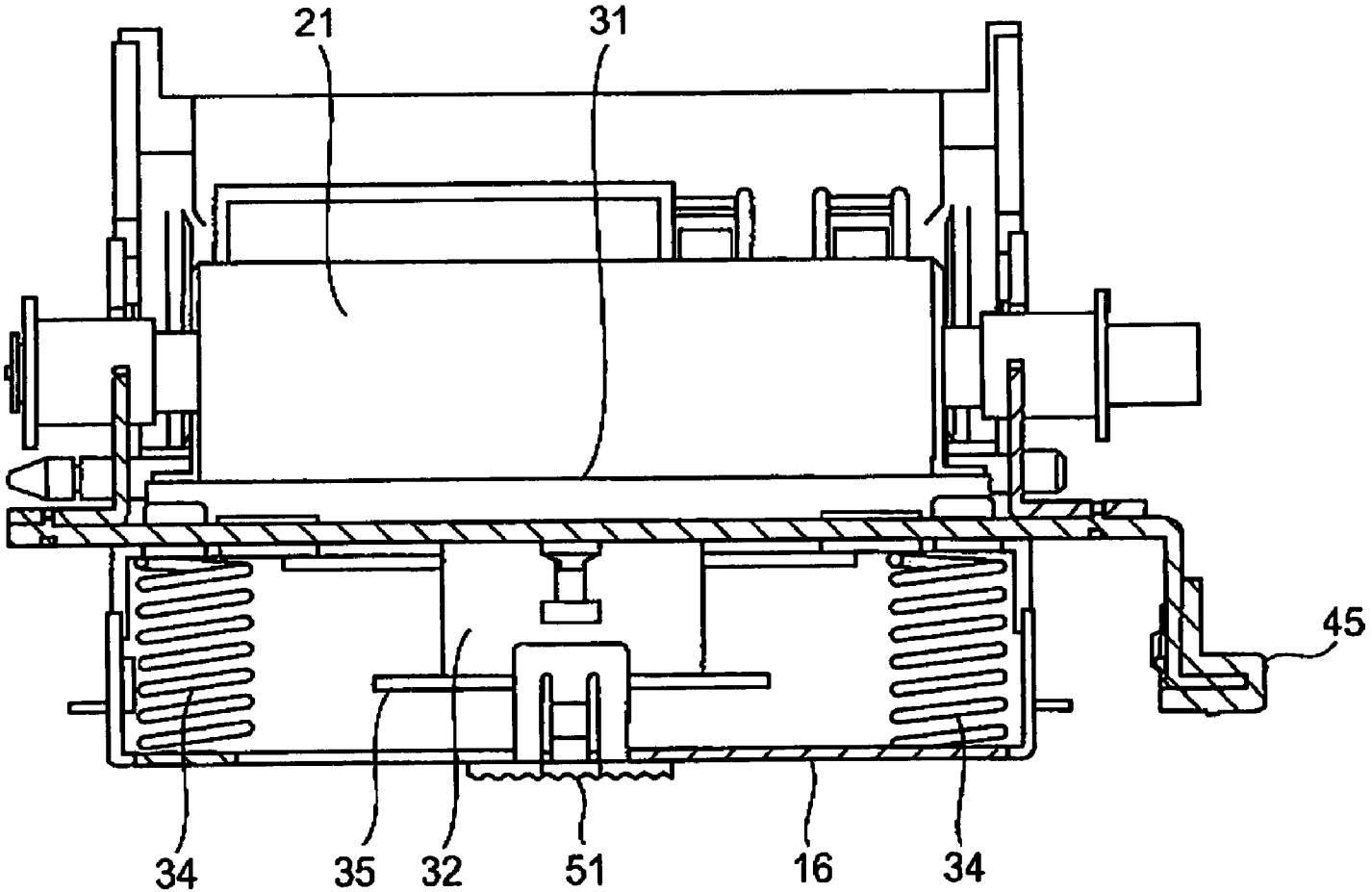
FIG. 8 is a plan view showing the main part of the thermal printer shown in FIG. 1 for explanation of operation of the thermal printer.

The user slides the head engagement member 51 rightward to move the head engagement member 51 to a position shown in FIGS. 7 and 8.

Figure 6:
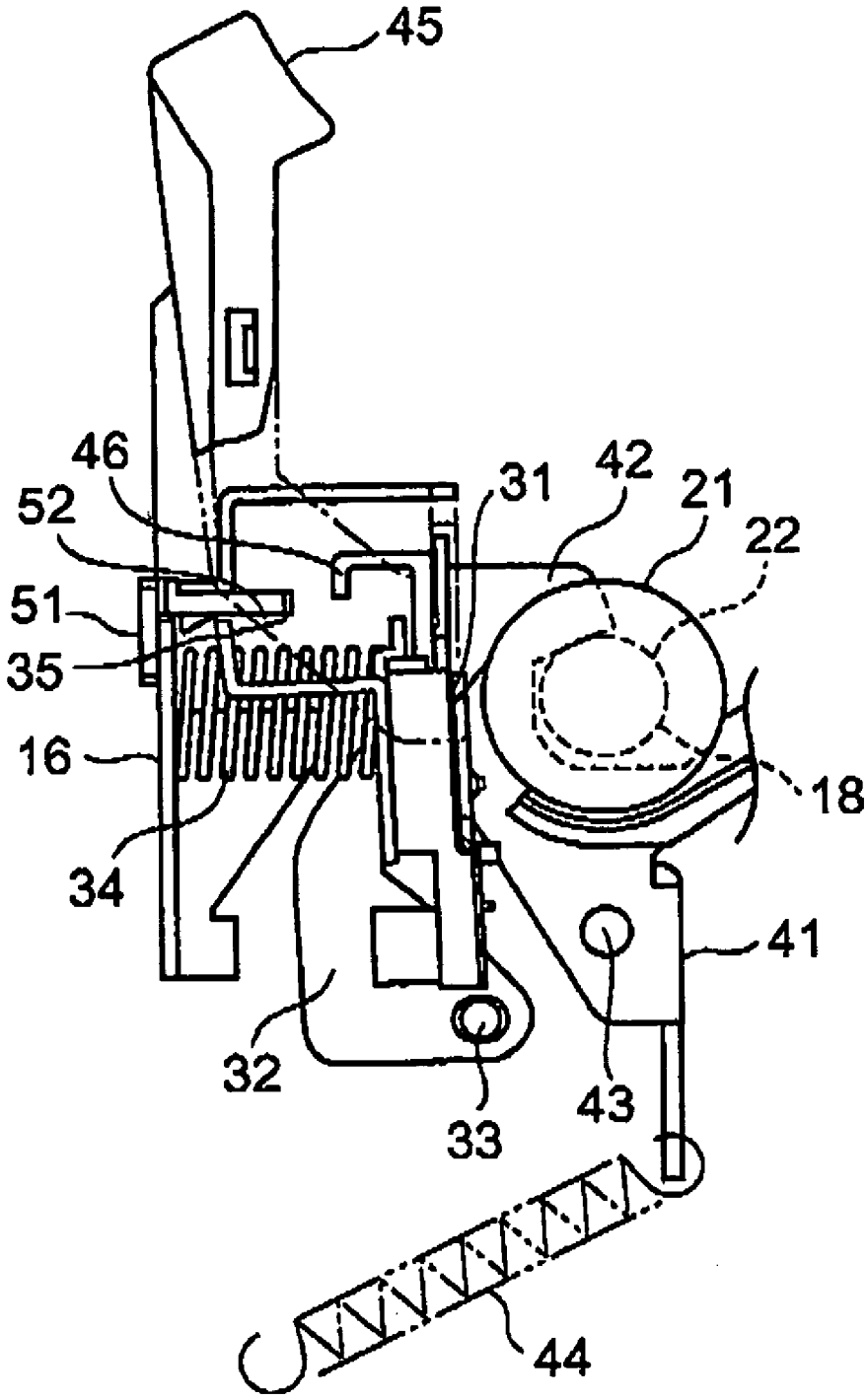
FIG. 6 is a view showing the main part of the thermal printer shown in FIG. 1 for explanation of operation of the cover open mechanism in the thermal printer.

As shown in FIGS. 3 and 6, the head engagement member 51 has a drive portion 52. As shown in FIG. 6, the drive portion 52 engages with the contact portion 35 of the head bracket 32. Accordingly, even if the cover operation member 41 is automatically returned from the third position to the first position by the tensile force of the coil spring 44 when the user looses his/her hand from the lever 45, the thermal head 31 remains separated from the platen 21 because of the engagement of the head engagement member 51 with the head bracket 32. This separated state is also maintained when the cover frame 12 is closed.

Since the cover frame 12 is latched by the hook portion 42 of the cover operation member 41, the cover frame 12 does not casually open.

The thermal head 31 presses a circumferential surface of the platen 21 under a considerably heavy load of about 1.5 kgf. For example, if the thermal head 31 presses the circumferential surface of the platen 21 for a long term in a warehouse, then a portion of circumferential surface of the platen 21 which contacts with the thermal head 31 is recessed to cause printing defects. The aforementioned head engagement structure can avoid such a problem.

In the head engagement structure according to the present invention, most of the mechanism for separating the thermal head from the circumferential surface of the platen can be shared with the cover open mechanism. Most of the head engagement operation is also common to the cover open operation. Accordingly, the thermal printer has a considerably simple arrangement, and operation of the thermal printer is remarkably facilitated. For example, these effects can clearly be understood from comparison with a complicated structure for preventing a platen from being recessed as disclosed by Japanese laid-open utility model publication No. 2-139752.

Although a certain preferred embodiment of the present invention have been shown and described in detail, it should be understood that various changes and modifications may be made therein without departing from the scope of the appended claims. For example, the present invention is applicable not only to thermal printers mounted on POS terminals or automatic dispensers, but also to thermal printers mounted on facsimile devices, measurement devices, electronic calculators, PDAs, or notebook computers. Additionally, the present invention is also applicable to stand-alone thermal printers.

What is claimed is:

1. A thermal printer comprising:

a base frame on which a thermal roll sheet is mounted;

a cover frame attached to said base frame so as to be opened and closed;

a platen mounted on said cover frame for feeding the thermal roll sheet;

a head bracket attached to said base frame in a movable state;

a thermal head mounted on said head bracket for printing on the thermal roll sheet between said platen and said thermal head, said thermal head being biased together with said head bracket so as to press said platen in a radial direction of said platen when said cover frame is closed; and a cover operation member movably attached to said base frame to selectively latch and unlatch said cover frame, said cover operation member being mechanically coupled with said head bracket so that said thermal head is separated from said platen;

wherein said cover operation member comprises:

a lever rotatable in clockwise and counterclockwise directions around a rotational axis on said base frame;

a hook portion extended from said lever to selectively latch and unlatch said platen; and a drive portion extended from said lever to drive said head bracket so that said thermal head is separated from said platen.

2. The thermal printer according to claim 1, further comprising a head engagement member engaging with said head bracket so that said thermal head is separated from said platen when said cover frame is closed.

3. The thermal printer according to claim 1, wherein said cover operation member latches a rotational shaft of said platen in a state in which said platen is allowed to rotate.

4. The thermal printer according to claim 1, wherein said cover frame is biased in a direction in which said cover frame is to be opened.

5. The thermal printer according to claim 1, wherein said cover operation member is biased toward a position so as to latch said cover frame.

6. The thermal printer according to claim 1, wherein said cover operation member which latches to said cover frame is fitted within an outline of said thermal printer including said base frame and said closed cover frame.

7. The thermal printer according to claim 1, wherein said cover frame, said head bracket, and said cover operation member are rotatably operated.

8. The thermal printer according to claim 1, wherein said cover operation member selectively moves between a first position to latch said cover frame that is closed and a second position to unlatch said cover frame and between said second position and a third position to press said head bracket so that said thermal head is separated from said platen, said third position being located farther away from the first position than the second position.

9. The thermal printer according to claim 8, wherein said head bracket is not pressed by said cover operation member when said cover operation member moves from said first position to said second position.

10. The thermal printer according to claim 1, wherein said hook portion selectively latches and unlatches said cover frame.

11. A cover open mechanism, used for a thermal printer comprising a base frame on which a thermal roll sheet is mounted, a cover frame attached to said base frame so as to be opened and closed, a platen mounted on said cover frame for feeding the thermal roll sheet, a head bracket attached to said base frame in a movable state, and a thermal head mounted on said head bracket for printing on the thermal roll sheet between said platen and said thermal head, said thermal head being biased together with said head bracket so as to press said platen in a radial direction of said platen when said cover frame is closed, said cover open mechanism comprising:

a cover operation member movably attached to said base frame to selectively latch and unlatch said cover frame, said cover operation member being mechanically coupled with said head bracket so that said thermal head is separated from said platen;

wherein said cover operation member comprises:

a lever rotatable in clockwise and counterclockwise directions around a rotational axis on said base frame;

a hook portion extended from said lever to selectively latch and unlatch said cover frame; and a drive portion extended from said lever to drive said head bracket so that said thermal head is separated from said platen.

12. The cover open mechanism according to claim 11, wherein the hook portion selectively latches and unlatches said platen.

13. The cover open mechanism according to claim 11, wherein said cover operation member latches a rotational shaft of said platen in a state in which said platen is allowed to rotate.

14. The cover open mechanism according to claim 11, wherein said cover operation member is biased toward a position so as to latch said cover frame.

15. The cover open mechanism according to claim 11, wherein said cover operation member that which latches to said cover frame is fitted within an outline of said thermal printer including said base frame and said closed cover frame.

16. The cover open mechanism according to claim 11, wherein said cover frame, said head bracket, and said cover operation member are operated with a turning movement.

17. The cover open mechanism according to claim 11, wherein said cover operation member selectively moves between a first position to latch said cover frame that is closed and a second position to unlatch said cover frame and between said second position and a third position to press said head bracket so that said thermal head is separated from said platen, said third position being located farther away from the first position than the second position.

18. The cover opening mechanism according to claim 17, wherein said head bracket is not pressed by said cover operation member when said cover operation member moves from said first position to said second position.

* * * * *